US009574791B2

(12) United States Patent
Lind et al.

(10) Patent No.: US 9,574,791 B2
(45) **Date of Patent: *Feb. 21, 2017**

(54) ACOUSTIC DISPERSING AIRFLOW PASSAGE

(71) Applicant: TRANE INTERNATIONAL INC., Davidson, NC (US)

(72) Inventors: Stephen John Lind, Onalaska, WI (US); Dustin Eric Jason Meredith, Lexington, KY (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/053,770

(22) Filed: Feb. 25, 2016

(65) Prior Publication Data

US 2016/0195299 A1 Jul. 7, 2016

Related U.S. Application Data

(63) Continuation of application No. 14/244,670, filed on Apr. 3, 2014, now Pat. No. 9,305,539.

(Continued)

(51) Int. Cl.
*F24F 13/24* (2006.01)
*G10K 11/16* (2006.01)

(Continued)

(52) U.S. Cl.
CPC ..... *F24F 13/24* (2013.01); *F24F 7/04* (2013.01); *F24F 7/065* (2013.01); *F24F 13/02* (2013.01);

(Continued)

(58) Field of Classification Search
CPC ..... F24F 13/24; F24F 13/242; F24F 13/245; G10K 11/161; F04D 29/664; F04D 29/665

(Continued)

(56) References Cited

U.S. PATENT DOCUMENTS 2,489,048 A 11/1949 Rinehart
3,019,850 A 2/1962 March (Continued)

OTHER PUBLICATIONS http://www.vibro-acoustics.com/products/noise-control/industrial-silencers/centrifugal-fan-silencers, available at least as early as Nov. 24, 2012, 1 pg.

(Continued)

*Primary Examiner* — Jeremy Luks
(74) *Attorney, Agent, or Firm* — Hamre, Schumann, Mueller & Larson, P.C.

(57) ABSTRACT

A plenum with features to disperse acoustic energy in an airflow while maintaining a relatively small pressure drop in the airflow is disclosed. A general structure of the plenum may include a perforated airflow passage surrounded by a substantially large space enclosed between the airflow passage and a plenum. The perforated airflow passage has a perforated wall that may allow the acoustic energy to be dispersed into the substantially large space when flowing through the airflow passage. Acoustic energy dispersing materials may also be disposed in the substantially large space and/or on the perforated wall to help disperse acoustic energy by, for example, absorbing the acoustic energy. The plenum can help disperse the acoustic energy while helping minimize the pressure drop in the airflow.

10 Claims, 9 Drawing Sheets

Related U.S. Application Data

(60) Provisional application No. 61/808,626, filed on Apr. 4, 2013.

(51) Int. Cl.
*F24F 7/04* (2006.01)
*F24F 13/02* (2006.01)
*F24F 7/06* (2006.01)

(52) U.S. Cl.
CPC ..... *G10K 11/161* (2013.01); *F24F 2013/242* (2013.01)

(58) Field of Classification Search
USPC ..... 181/224, 225
See application file for complete search history.

(56) References Cited

U.S. PATENT DOCUMENTS

| | | | |
|---|---|---|---|
| 3,033,307 | A | 5/1962 | Sanders et al. |
| 3,125,286 | A | 3/1964 | Sanders |
| 3,511,336 | A | 5/1970 | Rink et al. |
| 3,540,547 | A | 11/1970 | Coward, Jr. |
| 4,236,597 | A | 12/1980 | Kiss et al. |
| 4,287,962 | A | 9/1981 | Ingard et al. |
| 4,336,863 | A | 6/1982 | Satomi |
| 4,432,434 | A | 2/1984 | Dean, Jr. |
| 4,508,486 | A | 4/1985 | Tinker |
| 5,869,792 | A | 2/1999 | Allen et al. |
| 6,386,317 | B1 | 5/2002 | Morohoshi et al. |
| 6,402,612 | B2 | 6/2002 | Akhtar et al. |
| 6,533,657 | B2 | 3/2003 | Monson et al. |
| 7,779,960 | B2 | 8/2010 | Tang et al. |
| 7,806,229 | B2 | 10/2010 | Dyck et al. |
| 7,891,464 | B2 | 2/2011 | Tang et al. |
| 9,305,539 | B2 * | 4/2016 | Lind ..... F24F 7/04 |
| 2008/0271945 | A1 | 11/2008 | Dyck et al. |
| 2010/0077754 | A1 | 4/2010 | Jangili |
| 2010/0077755 | A1 | 4/2010 | Jangili et al. |

OTHER PUBLICATIONS http://www.pricenoisecontrol.com/industrial_process.aspx, available at least as early as Nov. 24, 2012, 5 pgs.

* cited by examiner

ACOUSTIC DISPERSING AIRFLOW PASSAGE

FIELD

The disclosure herein relates to a heating, ventilation and air conditioning (HVAC) system. Particularly the disclosure herein relates to a plenum that includes features configured to disperse acoustic energy when an airflow flows through an airflow passage of the plenum. The plenum can help attenuate and/or reduce the noise of the HVAC system.

BACKGROUND

A HVAC system typically includes one or more fans to drive an airflow to flow through a generally closed plenum. The operation of the fan, and/or other components of the HVAC system may produce noise in the plenum of the HVAC system. For example, noise can be produced when the airflow moves through or past fan blades.

SUMMARY

Embodiments disclosed herein generally relate to a plenum of, for example, a HVAC system, that may include features to help disperse acoustic energy while helping minimize a pressure drop in the airflow. The embodiments of plenum as disclosed herein may help attenuate and/or reduce noise in the airflow.

A general structure of the embodiments disclosed herein may include an airflow passage positioned in a plenum, where the airflow passage may be configured to allow acoustic energy to be dispersed into the plenum. The embodiments as disclosed herein may have the acoustic dispersing effect of a traditional plenum, while having a relatively small pressure drop similar to an airflow duct made of a solid material.

In some embodiments, the airflow passage may include a perforated wall. The airflow passage and the perforated wall are surrounded by a substantially large enclosed space between the airflow passage and a plenum housing. The term "substantially large", for example, is relative to the airflow passage. Generally, the substantially large space means that the space surrounding the airflow passage is larger than the space defined by the airflow passage.

The perforated airflow passage may allow the acoustic energy to be dispersed into the enclosed space when the airflow flows through the perforated airflow passage due to, for example, impedance mismatch. The substantially large space surrounding the perforated airflow passage may help disperse acoustic energy by, for example, acoustic reactance of the space.

The perforated airflow passage may also help contain most of the airflow inside the airflow passage. The airflow may be expanded into the enclosed space surrounding the airflow passage through openings of the perforated wall, which may increase an air pressure in the enclosed space surrounding the airflow passage. The increase of the air pressure in the enclosed space may help prevent the airflow from flowing out of the perforated wall. This can help contain the airflow in the perforated airflow passage, so that the perforated airflow passage in the plenum may behave like a "virtual duct", resembling an airflow duct that is made of a solid material. As a result, when the airflow flows through the airflow passage, a pressure drop in the airflow may be relatively small. The plenum as disclosed herein allows the acoustic benefits, e.g. multiple expansions and/or contractions, of a traditional plenum, while reducing the pressure drop compared to a traditional plenum. The embodiments as disclosed herein may have the benefit of acoustic energy dispersing properties of the plenum, while behaving like a "virtual duct" that help minimize a pressure drop in the airflow.

In some embodiments, a cross section of the airflow passage may be configured to match a profile, such as shape and size, of a discharge of a fan. When the profile of the airflow passage is properly configured relative to dimensions of the discharge of the fan, the airflow passage may act as an airflow duct, which may allow static pressure regain.

In some embodiments, the perforated wall may be provided by a perforated sheet metal.

In some embodiments, an acoustic energy dispersing material (such as fiberglass), may be disposed in the enclosed space and/or on the perforated wall to help disperse acoustic energy by, for example, absorbing the acoustic energy. In some embodiments, the acoustic energy dispersing material may be disposed next to the airflow passage.

Other features and aspects of the embodiments will become apparent by consideration of the following detailed description and accompanying drawings.

BRIEF DESCRIPTION OF THE DRAWINGS

Reference is now made to the drawings in which like reference numbers represent corresponding parts throughout.

FIG. 2A illustrates a front perspective view of the plenum and a fan. FIG. 2B illustrates an exemplary perforated sheet metal that can be used to provide a perforated wall of an airflow passage. FIG. 2C is a sectional view along a line 2C-2C in FIG. 2A. FIG. 2D is a sectional view along a line 2D-2D in FIG. 2A.

FIG. 3A illustrates a plenum with an airflow passage that is positioned next to a discharge of a fan, according to one embodiment. FIG. 3B illustrates a plenum with an airflow passage that is positioned next to an inlet of a fan, according to another embodiment. FIG. 3C illustrates another embodiment of a plenum with an airflow passage that is positioned next to a discharge of a fan.

FIG. 4A illustrates a plenum with an airflow passage that is positioned next to an inlet of a plenum fan, according to one embodiment. FIG. 4B illustrates a plenum with an airflow passage that is positioned next to an inlet of a plenum fan, according to another embodiment. FIG. 4C illustrates a plenum with an airflow passage that is positioned next to a discharge of a plenum fan, according to another embodiment.

FIG. 5A illustrates a plenum installed on a discharge of one fan of the outdoor unit. FIG. 5B illustrates an exploded view of an exemplary plenum that is configured to work with the outdoor unit. FIG. 5C illustrates an exemplary airflow passage of the plenum. FIG. 5D illustrates an end view of the plenum.

DETAILED DESCRIPTION

Noise can be produced when an airflow is driven through a ductwork, such as a plenum of a HVAC system, by a fan or when the airflow moves through fan blades. In some HVAC systems, attempts have been made to reduce the noise in the plenum.

Figure 1A:
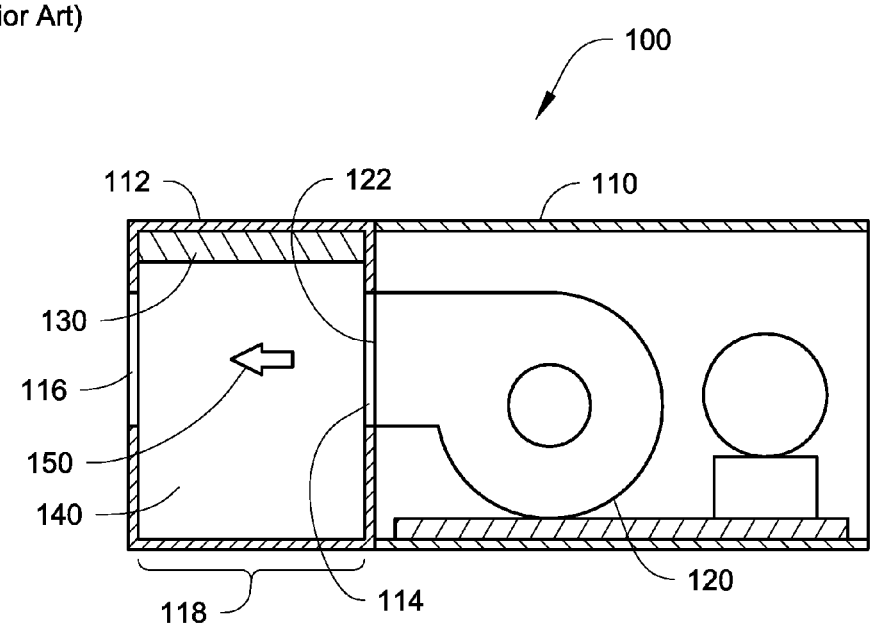
Fig. 1A (Prior Art)
FIGS. 1A and 1B illustrate typical configurations directed to disperse acoustic energy in a plenum of a HVAC system.
Figure 1B:
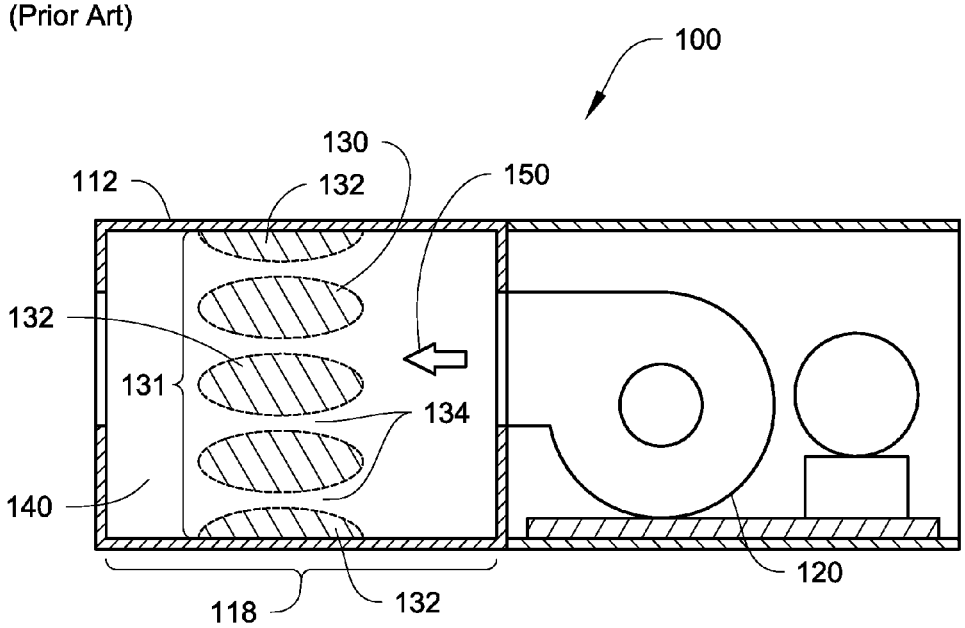
Fig. 1B (Prior Art)

FIGS. 1A and 1B illustrate schematic cross section views of typical configurations of a plenum 110 in a HVAC system 100 designed to disperse acoustic energy when an airflow 150 flows through the plenum 110. A fan 120 is enclosed in the plenum 110. The term "plenum" typically means a manifold that is typically substantially larger in size than what may be necessary to allow an airflow to flow through. The relatively large size of the plenum 110 may help disperse acoustic energy.

As illustrated in FIG. 1A, the plenum 110 has a discharge plenum 112, which is configured to direct the airflow 150 out of a discharge 122 of the fan 120. The airflow 150 and its direction are represented in the figures by a block arrow. The discharge plenum 112 of the plenum 110 includes an inlet 114 and an outlet 116. The inlet 114 is configured to fit the discharge 122 of the fan 120 and may be configured to receive the airflow 150 discharged by the fan 120. The outlet 116 is configured to direct the airflow 150 out of the discharge plenum 112. The discharge plenum 112 includes an intermediate portion 118 having a space 140 that has a relatively large size.

When the airflow 150 flows from the inlet 114 into the intermediate portion 118, the airflow 150 may have an expansion because of the relatively large size of the space 140 of the intermediate portion 118. This expansion may create, for example, impedance mismatch in acoustic energy of the airflow 150. As a result, the acoustic energy is dispersed into the space 140 of the intermediate portion 118, reducing the noise. The acoustic energy may be dispersed, for example, due to acoustic reactance of the space 140. However, the expansion of the airflow 150 may cause a pressure drop in the airflow 150.

In some embodiments, the discharge plenum 112 may include one or more layers of acoustic dispersing material 130, such as fiberglass. The acoustic dispersing material 130 can help disperse the acoustic energy by, for example, absorbing the acoustic energy.

When the airflow flows from the intermediate portion 118 to the outlet 116, the airflow 150 can be contracted, which may also cause impedance mismatch in the acoustic energy, resulting in noise reduction. However, the contraction of the airflow can also cause a pressure drop. Therefore, the discharge plenum 112 as illustrated in FIG. 1A, even though it has the benefit of reducing noise in the airflow 150, may cause a pressure drop in the airflow 150 when the airflow 150 flows through the discharge plenum 112. The pressure drop may not be desirable.

As illustrated in FIG. 1B, in some embodiments, the discharge plenum 112 may also include a silencer 131 positioned in the space 140 of the intermediate portion 118 of the discharge plenum 112. The silencer 131 may include one or more silencing members 132 arranged in a direction that is generally perpendicular to the airflow 150. Each of the silencing members 132 may include an acoustic energy dispersing material 130, e.g. fiberglass. The neighboring silencing members 132 are configured to form one or more channels 134 to allow the airflow 150 to pass through.

When the airflow 150 flows through the channels 134 of the silencer 131, the acoustic energy dispersing material 130 can absorb acoustic energy in the airflow 150. A pressure drop may be caused by the airflow 150 flowing through the channels 134, because the relatively smaller size of the channels 134 relative to the size of the discharge plenum 112. The silencer 131 generally is not configured to disperse the acoustic energy by causing expansion of the airflow, such as caused by the plenum 112.

The plenum configurations as illustrated in FIGS. 1A and 1B, while they may help disperse the acoustic energy, may cause undesirable pressure drop in the airflow. Improvements that may help disperse acoustic energy while helping minimize the pressure drop in the airflow may be desired.

The acoustic energy dispersing material 130 can also help disperse acoustic energy. The effect of the acoustic energy dispersing material 130 may be different from the plenum 112. For example, in some embodiments, the acoustic energy dispersing material 130 (e.g. fiberglass) may help disperse the acoustic energy better than the plenum 112 when the acoustic frequency is relatively high. The acoustic dispersing effect of the plenum 112 may be more effective than the acoustic energy dispersing material 130 when the frequency is relatively low.

Embodiments disclosed herein generally relate to a plenum that may include features to help disperse acoustic energy. The plenum may be a section of a plenum system of a HVAC system and may be positioned next to a discharge and/or an inlet of a fan. A general structure of the embodiments of the plenum disclosed herein may include an airflow passage with a perforated wall surrounded by a substantially large space enclosed between the airflow passage and a plenum housing. The perforated airflow passage may behave like a "virtual duct" when the airflow flows through therein, while allowing the acoustic energy to be dispersed through openings of the perforated wall into the surrounding space. The embodiments as disclosed herein may have the benefit of acoustic energy dispersing properties of the plenum, while behaving like a "virtual duct" that may help minimize a pressure drop in the airflow.

The perforated wall may allow acoustic energy in the airflow to disperse through openings of the perforated wall. For example, when the airflow flows through the perforated airflow passage, the airflow may expand suddenly into the space through the openings, which may help disperse the acoustic energy. The acoustic energy dispersed through the opening of the perforated wall may be dispersed in the space surrounding the airflow passage by, for example, acoustic reactance of the space.

The airflow in the airflow passage may expand into the space surrounding the airflow passage. This may help increase an air pressure in the space, providing a resistance to an airflow flowing through the airflow passage. In some embodiments, the resistance may help retain the airflow inside the passage, so that the passage may behave like an airflow duct made of a solid metal to the airflow. Thus, a pressure drop in the airflow when flowing through the airflow passage may be relatively small. In some embodiments, acoustic energy dispersing materials (such as fiberglass), may be disposed in the space and/or on the perforated wall to help disperse acoustic energy by, for example, absorbing the acoustic energy. The embodiments of the plenum as disclosed herein may help disperse acoustic energy in the airflow so as to reduce noise of the airflow while causing a relatively small pressure drop when the airflow flowing through the plenum.

References are made to the accompanying drawings that form a part hereof, and in which are shown by way of illustration of embodiments of a plenum and an airflow passage of a plenum that may be practiced. It is to be understood that the terms used herein are for the purpose of describing the figures and embodiments and should not be regarding as limiting in scope.

Figure 2A:
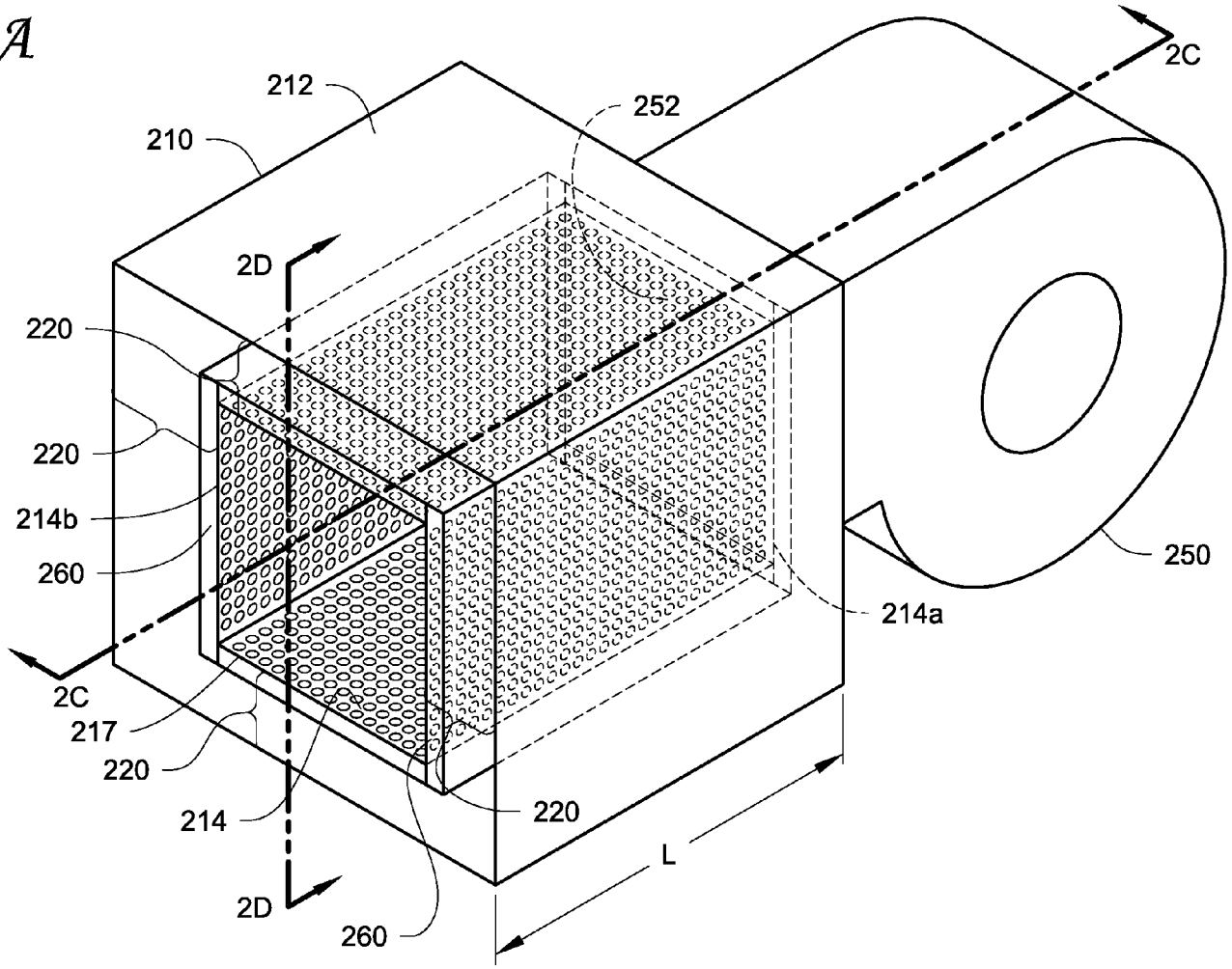
FIGS. 2A to 2D illustrate a plenum that includes features to help disperse acoustic energy, according to one embodiment.
Figure 2B:
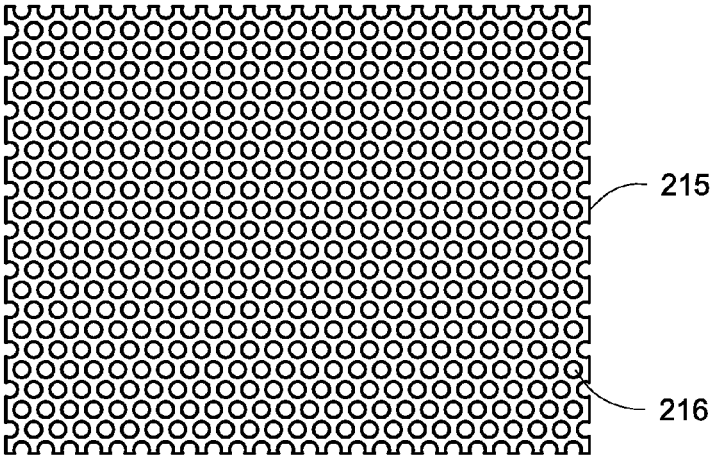
Figure 2C:
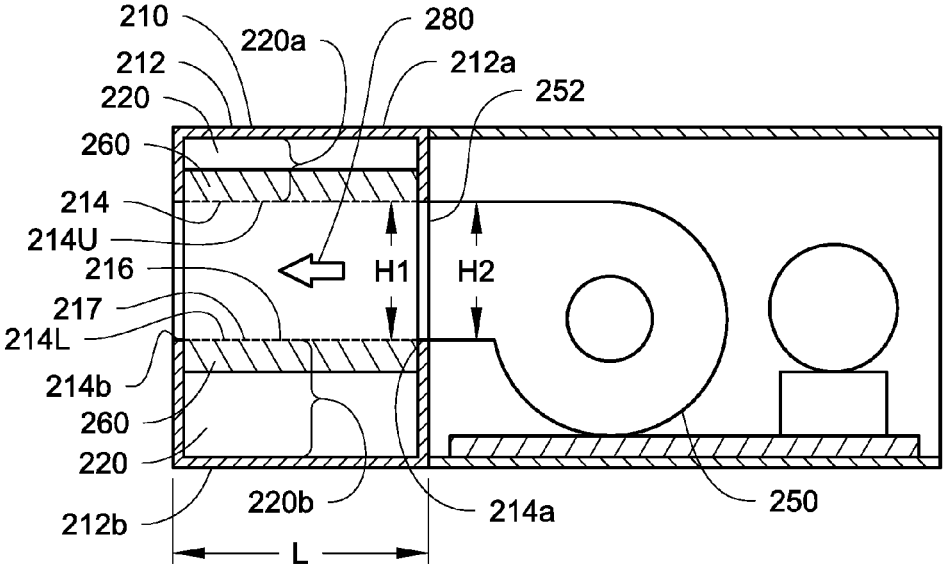

FIGS. 2A to 2D illustrate one embodiment of a plenum 210 that is configured to disperse acoustic energy while helping reduce a pressure drop in an airflow (e.g. the airflow 280 in FIG. 2C). The plenum 210 includes a plenum housing 212 and an airflow passage 214 enclosed by the plenum housing 212. The plenum housing 212 may be generally made of a solid sheet material (e.g. sheet metal).

The airflow passage 214 has a perforated wall 217. The perforated wall 217 of the airflow passage 214 may be made of, for example, a perforated sheet metal 215 as illustrated in FIG. 2B. The perforated sheet metal 215 is generally a sheet metal with a plurality of openings 216. The plurality of openings 216 allow fluid communication between the airflow passage 214 defined by the perforated wall 217 and the space 220 defined between the plenum housing 212 and the perforated wall 217.

Referring to FIG. 2A, the airflow passage 214 and the plenum housing 212 define a space 220 between the airflow passage 214 and the plenum housing 212. Relative to a longitudinal direction that is defined by a length L of the plenum 210, the airflow passage 214 generally has a relatively uniform cross section shape.

The airflow passage 214 has a first end 214*a* and a second end 214*b*. In the illustrated embodiment in FIG. 2A, the plenum 210 is positioned next to a discharge 252 of a fan 250, with the understanding that the plenum 210 may also be positioned away from the discharge 252. The first end 214*a* can be configured to match a profile (such as size and shape) of the discharge 252. As a result, when a discharge airflow driven by the fan 250 is received by the airflow passage 214 through the first end 214*a*, the pressure drop in the airflow may be relatively small.

In some embodiments, a layer of acoustic energy dispersing material 260 may be disposed in the space 220. In some embodiments, the layer of acoustic energy dispersing material 260 may be disposed next to the perforated wall 217 of the airflow passage 214 and extend along the longitudinal direction that is defined by the length L. In some embodiments, the layer of acoustic energy dispersing material 260 may fill a portion of the space 220.

FIG. 2C illustrates a cross-section view along a line 2C-2C in FIG. 2A. The plenum 210 generally has the plenum housing 212 enclosing the airflow passage 214 that has the perforated wall 217. The plenum housing 212 and the airflow passage 214 define a space 220 therebetween. The plenum housing 212 is generally substantially larger than the airflow passage 214. The space 220 is therefore substantially larger than a volume defined by the airflow passage 214. In some embodiments, the volume of the space 220 is about two times larger or more than the volume defined by the airflow passage 214. In some embodiments, a cross section of the space 220 is two times or more than the cross section of the airflow passage 214. (See FIG. 2D.)

The airflow passage 214 has the first end 214*a* and the second end 214*b*. The first end 214*a* is configured to match the profile of the discharge 252 of the fan 250. The airflow passage 214 has a height H1 that is about the same as a height H2 of the discharge 252. See e.g. FIG. 2C. Along the length L of the plenum 210, the height H1 of the airflow passage 214 is generally constant. The airflow passage 214 is generally aligned with the discharge 252 of the fan 250. This configuration may help reduce a pressure drop when the airflow flows through the airflow passage 214. When the profile of the airflow passage 214 is properly configured relative to dimensions of the discharge 252 of the fan 250, the airflow passage 214 may act as an airflow duct, which may allow static pressure regain.

As illustrated in FIG. 2C, the size of the space 220 between the airflow passage 214 and different sides of the plenum housing 212 may vary. For example, as illustrated in FIG. 2C, a space 220*a* between an upper side 214U and a upper side 212*a* of the plenum housing 212 may be configured to be smaller than a space 220*b* between a lower side 214L and a lower side 212*b* of the plenum housing 212.

Figure 2D:
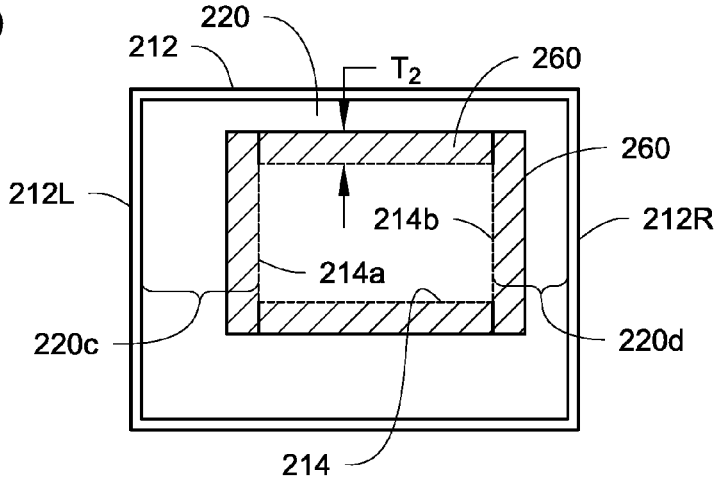

Similarly, as shown in FIG. 2D, the space 220 between side walls 214*a*, 214*b* of the airflow passage 214 and side walls 212L, 212R of the plenum housing 212 may also be varied. For example, as illustrated in FIG. 2D, a space 220*c* between the side wall 214*a* and the side wall 212L of the plenum housing 212 may be configured to be smaller than a space 220*d* between the side wall 214*b* and the side wall 212R of the plenum housing 212. The different sizes of the spaces 220*a*, 220*b*, 220*c* and 220*d* may cause a peak acoustic reactance of the spaces 220*a-d* to be at different acoustic frequency ranges. The different sizes of the spaces 220*a*, 220*b*, 220*c* and 220*d* may help the plenum housing 212 have multiple acoustic reactance peaks corresponding to multiple acoustic frequency ranges.

The layer of the acoustic energy dispersing material 260 may be disposed in the space 220. Referring to FIGS. 2C and 2D together, the layer of acoustic energy dispersing material 260 may be disposed next to the perforated wall 217 of the airflow passage 214, with the understanding that this is exemplary. Generally, the thicker the acoustic energy dispersing material 260 is, the better the acoustic energy dispersing effect. In some embodiments, a thickness T2 of the acoustic energy dispersing material 260 may be about 1 to about 4 inches.

When the acoustic energy disperses into the space 220 through the openings 216 of the airflow passage 214, the acoustic energy may be dispersed by the acoustic dispersing material 260 by, for example, absorbing the acoustic energy. Some acoustic dispersing material may include fiberglass, and/or foam.

As shown in FIG. 2C, in operation, an airflow 280 discharged by the fan 250 may be received by the first end 214*a* of the airflow passage 214. The airflow 280 is shown as a block arrow in FIG. 2C.

Because the size and the shape of the discharge 252 are about the same as the first end 214*a*, a pressure drop in the airflow 280 when the airflow 280 is received by the first end 214*a* is relatively small.

The airflow is then directed by the airflow passage 214 along the perforated wall 217. As illustrated in FIG. 2B, the perforated wall 217 may be provided by, for example, a perforated sheet metal 215 with the openings 216.

When the airflow 280 flows into the perforated airflow passage 214, the acoustic energy can be dispersed through the openings 216 of the perforated wall 217 into the relatively large space 220 surrounding the perforated wall 217. This may help disperse the acoustic energy away from the airflow passage 214 into the space 220. Dispersing the acoustic energy into the relatively large space 220 may help reduce sound/noise in the airflow 280.

The space 220 is confined by the plenum housing 212. When the airflow 280 flows through the airflow passage 214, some portion of the airflow 280 may expand into the space 220 through the openings 216 relatively quickly. The expansion of the airflow 280 may increase an air pressure in the confined space 220. The increase of the air pressure in the space 220 may help retain the airflow 280 inside the airflow passage 214. In other words, the pressure increase caused by initial expansion of the airflow 280 in the airflow passage 214 may generally prevent the airflow 280 from flowing out of the perforated wall 217 of the airflow passage 214 (e.g. through the openings 216 of the sheet metal 215 in FIG. 2B). As a result, the airflow passage 214 may behave like an airflow duct made with a solid material, and have a relatively small pressure drop when the airflow 280 flows through therein.

The size and the density of the openings 216 may be varied. An optimal opening size and/or density may be obtained by testing in a laboratory and/or by computer simulation, for example. In some embodiments, a total area of the openings 216 is about 15% to 58% of a total area of the corresponding perforated sheet metal 215.

When the airflow passage 214 are configured so that the airflow passage 214 generally does not allow the airflow 280 to flow out of the openings 216, the airflow passage 214 generally behaves or functions as a solid walled duct, e.g. that is made of solid sheet metal. Therefore, when the airflow 280 flows through the airflow passage 214, the pressure drop in the airflow 280 may be relatively small. When the airflow 280 flows out of the airflow passage 214 through the second end 214*b*, the pressure drop in the airflow may be relatively small also because the size and the shape of the second end 214*b* generally matches the profile of the airflow passage 214.

In a typical plenum, a relative large size of the plenum may have a good acoustic energy dispersing effect, but may cause a relatively large pressure drop in an airflow flowing through therein. A typical duct may cause a relatively small pressure in the airflow flowing through therein, but may have relatively small acoustic energy dispersing effect. The embodiments as disclosed herein, which generally includes the plenum housing 212 enclosing the perforated airflow passage 214, may allow acoustic energy to be dispersed into the space 220 surrounding the perforated airflow passage 214, while helping retain most of the airflow 280 inside the airflow passage 214. This may allow the acoustic dispersing effect of a typical plenum, while helping minimize the pressure drop in the airflow 280, e.g. while behaving like a typical duct.

In some embodiments, the size of the space 220 between the perforated wall 217 of the airflow passage 214 and the plenum housing 212 may vary. As illustrated in FIGS. 2C and 2D, the upper space 220*a*, the lower space 220*b*, and the spaces 220L and 220R may have different sizes. That is, relative positions of the airflow passage 214 with respect to the sides 212*a*, 212*b*, 212L and 212R of the plenum housing 212 may not necessarily be the same. By varying the relative positions of the airflow passage 214 with respect to the sides 212*a*, 212*b*, 212L and 212R, the plenum 210 may be tuned to disperse acoustic energy of a relatively wide range of frequencies. The spaces 220*a*, 220*b*, 220L and 220R with different sizes may provide a peak acoustic reactance at different acoustic frequency ranges. Thus, the space 220 can be optimized to disperse acoustic energy at different frequency ranges.

In some embodiments, a layer of acoustic energy dispersing material can be disposed in the space 220. As illustrated, the acoustic energy dispersing material can be disposed next to the perforated wall 217 of the airflow passage 214. The acoustic energy can also be dispersed by the acoustic disperse material by, for example, absorbing the acoustic energy. Some acoustic disperse material may include, for example, fiberglass, foam.

Generally, the longer the length L of the plenum 210 is, the better the acoustic energy dispersing effect. In some specific embodiments, a plenum of about 1 to 6 feet in length may provide observable acoustic energy dispersion effects. Embodiments of plenum as disclosed herein may be generally suitable for dispersing acoustic energy when the acoustic frequency is relatively low (such as about 50 to 100 Hz). Embodiments of a plenum as disclosed herein may also be suitable for helping disperse acoustic energy when the acoustic frequency is about 200 Hz to about 2000 Hz.

The embodiment as disclosed in FIGS. 2A to 2D discloses the plenum 210 that may include features to disperse acoustic energy in an airflow while causing a relatively small pressure drop in the airflow. The embodiments are exemplary. Generally, a plenum that includes features to disperse acoustic energy while causing a relatively small pressure drop in the airflow may include an airflow passage with a perforated wall positioned in the plenum. The airflow passage may be surrounded by an enclosed space (for example, the space 220 that is enclosed by the plenum 210) that is substantially larger than the airflow passage. The perforated wall allows the airflow passing through the airflow passage to disperse the acoustic energy into the relatively large space surrounding the airflow passage. The acoustic energy can be dispersed by, for example, acoustic reactance of the space. The airflow may expand into the space, causing pressure increase in the space. The pressure increase in the space may help retain the airflow inside the airflow passage when the airflow flows through the airflow passage. As a result, even though the airflow passage may include perforated wall that allows the airflow to disperse the acoustic energy, the airflow passage may act as a "virtual duct" that behaves like a duct made of a solid material. Hence, the pressure drop in the airflow may be relatively small when flowing through the plenum.

In some embodiments, an acoustic energy dispersing material may be used. The acoustic energy may be dispersed by the dispersing material by, for example, absorbing the acoustic energy. The acoustic energy dispersing material can be positioned in the space and/or next to the perforated wall of the airflow passage. The airflow passage can be positioned in a plenum duct system of a HVAC system.

Figure 3A:
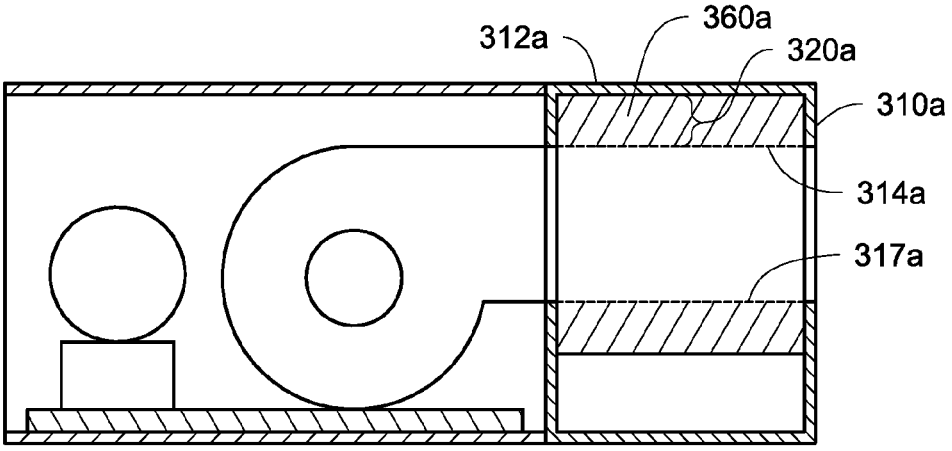
FIGS. 3A to 3C illustrate different configurations of a plenum and a fan.
Figure 3B:
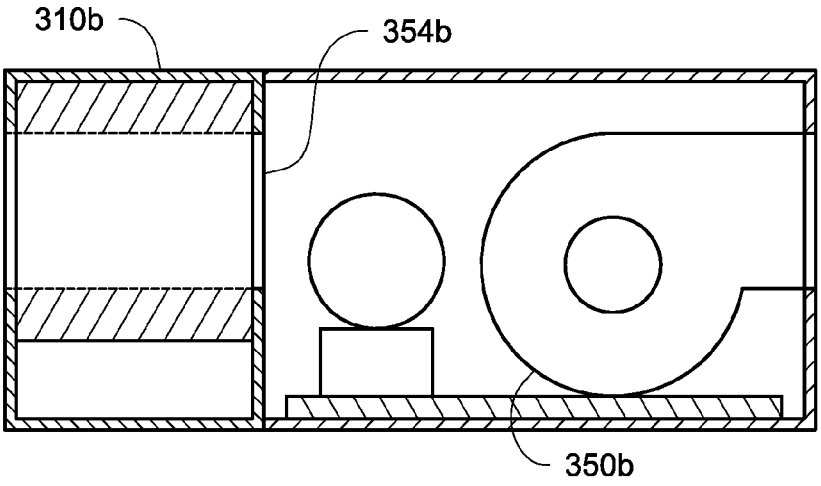
Figure 3C:
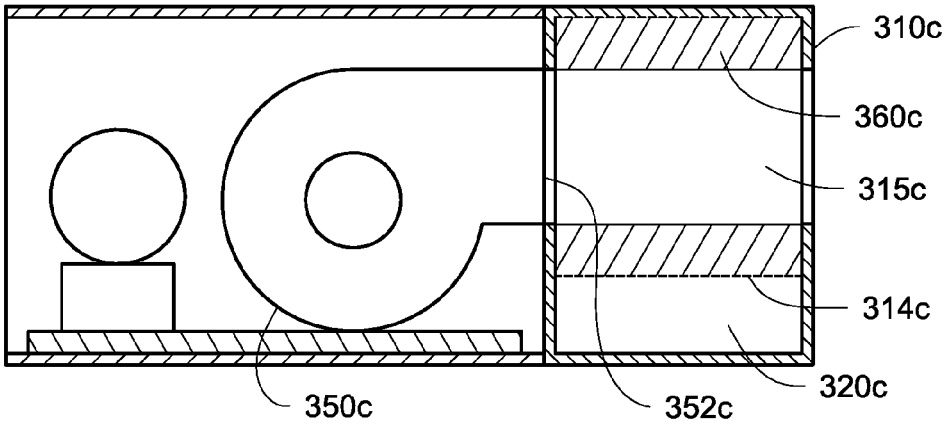

FIGS. 3A to 3C illustrate different embodiments of plenums 310*a*, 310*b* and 310*c* respectively that include features to help disperse acoustic energy.

FIG. 3A illustrates that in some embodiments, a space 320*a* between a side of an airflow passage 314*a* with a perforated wall 317*a* and a side of a plenum 312*a* may be filled with an acoustic energy dispersing material 360*a*.

FIG. 3B illustrates that the plenum 310*b* with features to disperse acoustic energy may also be positioned next to an air inlet 354*b* for the fan 350*b*. It is noted that generally all the embodiments as disclosed herein can be positioned next to an air inlet and/or discharge for the fan.

FIG. 3C illustrates that in one embodiment of a plenum 310*c*, relative to an airflow passage 315*c*, an acoustic energy dispersing material 360*c* may be positioned over a perforated material 314*c*. In the embodiment as illustrated in FIG. 3C, the airflow passage 315*c* is generally immediately surrounded by the acoustic energy dispersing material 360*c*. The airflow passage 315*c* is configured to match a profile (including for example size and shape) of a discharge 352*c* of a fan 350*c*. Acoustic energy can be dispersed by the acoustic energy dispersing material 360*c* first, then dispersed through the perforated material 314*c* into a space 320*c*.

It is to be understood that FIGS. 2A, 2C, 2D, and 3A to 3C generally illustrate a centrifugal fan. This is exemplary. The embodiments as disclosed herein can generally be used with other types of fans, including, for example, direct drive plenum fans, axial fans or other suitable types of fans.

Figure 4A:
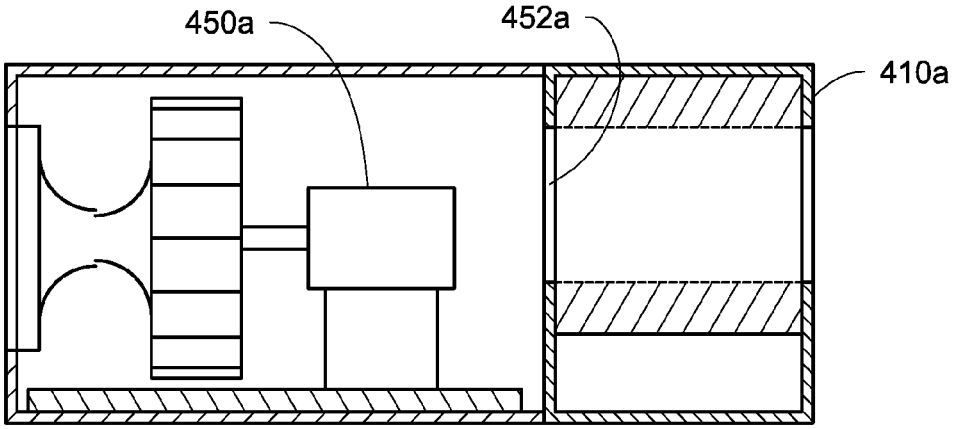
FIGS. 4A to 4C illustrates different embodiments of a plenum that is adapted to work with a direct drive plenum fan.
Figure 4B:
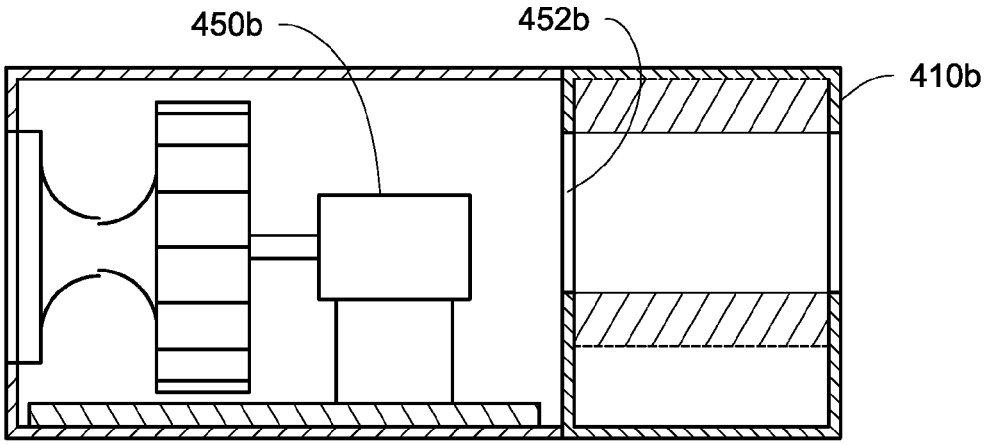
Figure 4C:
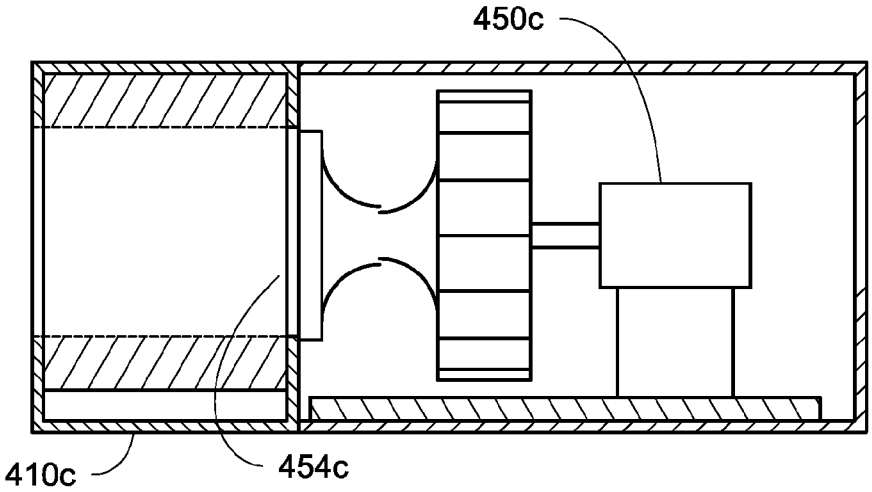

FIGS. 4A to 4C illustrate that embodiments of plenums 410*a*, 410*b* and 410*c* respectively may be used with plenum fans 450*a*, 450*b*, and 450*c* respectively. The plenums 410*a*, 410*b* and 410*c* may include features configured to help disperse acoustic energy.

As illustrated in FIGS. 4A and 4B, the airflow passages 410*a* and 410*b* may be positioned next to an inlet 452*a* and 452*b* of the fans 450*a*, 450*b* respectively. As illustrated in FIG. 4C, the airflow passage 410*c* can be positioned next to a discharge 454*c* of the fan 450*c*.

It is to be noted that all the embodiments of the plenums as disclosed herein can generally be positioned at the discharge and/or the inlet for the fan. In some embodiments, the plenums can be positioned next to the fan. In some embodiments, the plenums can be positioned away from the discharge and/or inlet of the fan.

FIGS. 5A to 5D illustrate a plenum 510 that may include features to disperse acoustic energy. The plenum 510 is used with an outdoor unit 570 of a HVAC system 500. The plenum 510 may be positioned on a discharge 552 of a fan 550.

Figure 5A:
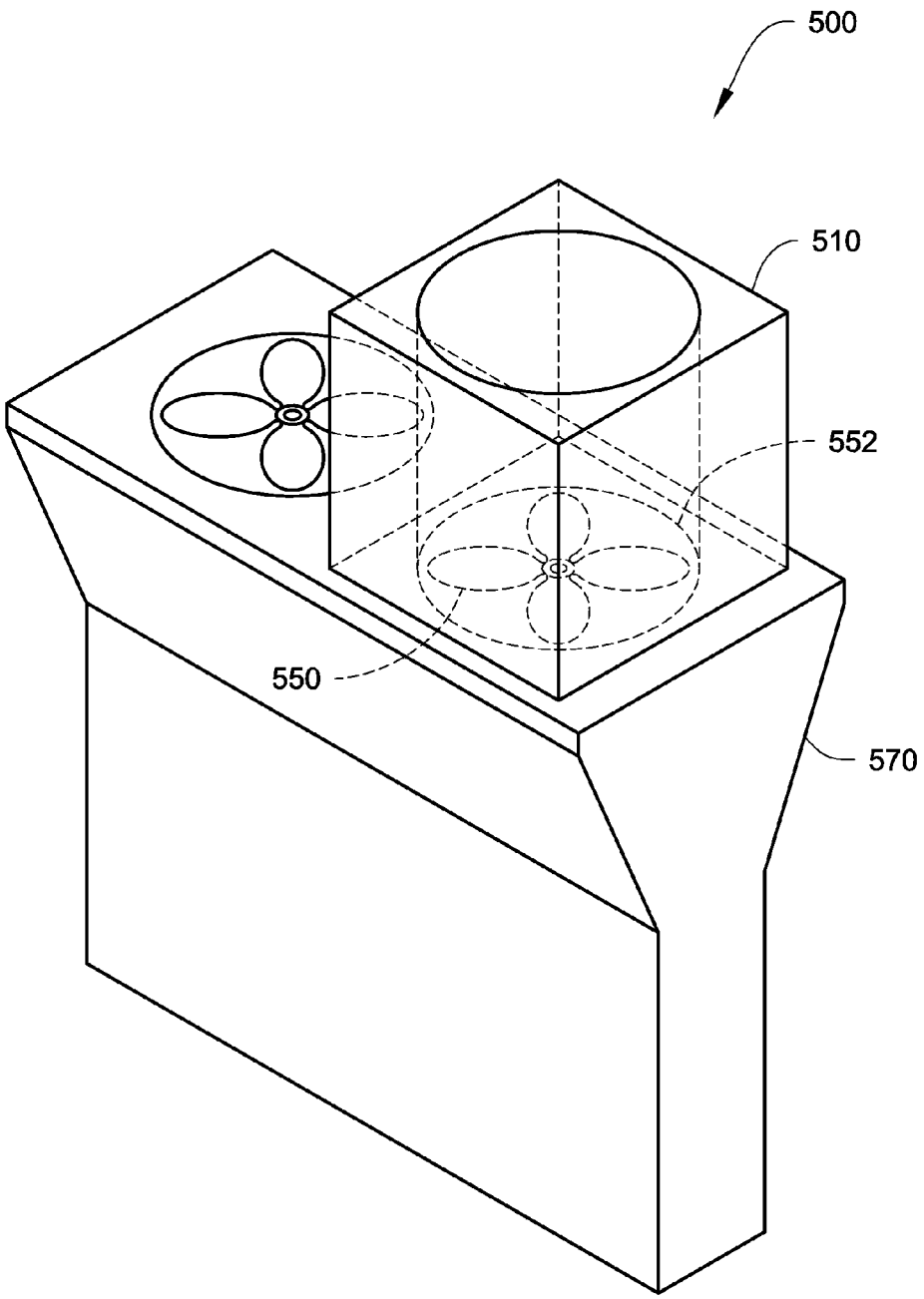
FIGS. 5A to 5D illustrate a plenum that is configured to work with an outdoor unit of a HVAC system.
Figure 5B:
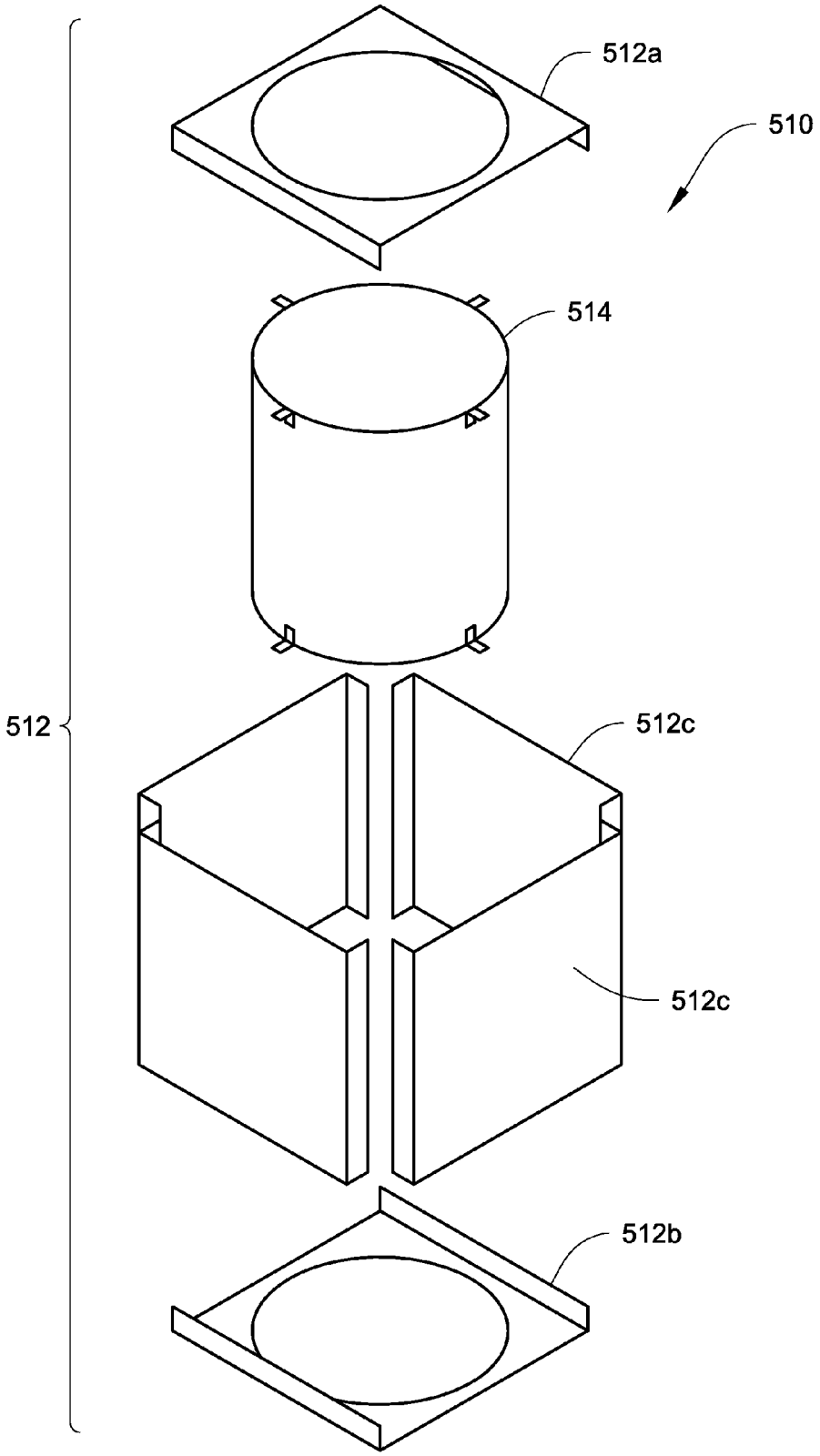

FIG. 5B illustrates an exploded view of the plenum 510, with the understanding that the structure as illustrated in FIG. 5B is exemplary and not meant to be a limitation.

The general structure of the plenum 510 includes an airflow passage 514 that is enclosed by a plenum housing 512 assembled, for example, by two end panels 512*a*, 512*b* and four side panels 512*c*. The panels 512*a*, 512*b* and 512*c* may be constructed with solid metal sheets. The airflow passage 514 and the plenum 512 define a space 520 as illustrated in FIG. 5D.

Figure 5C:
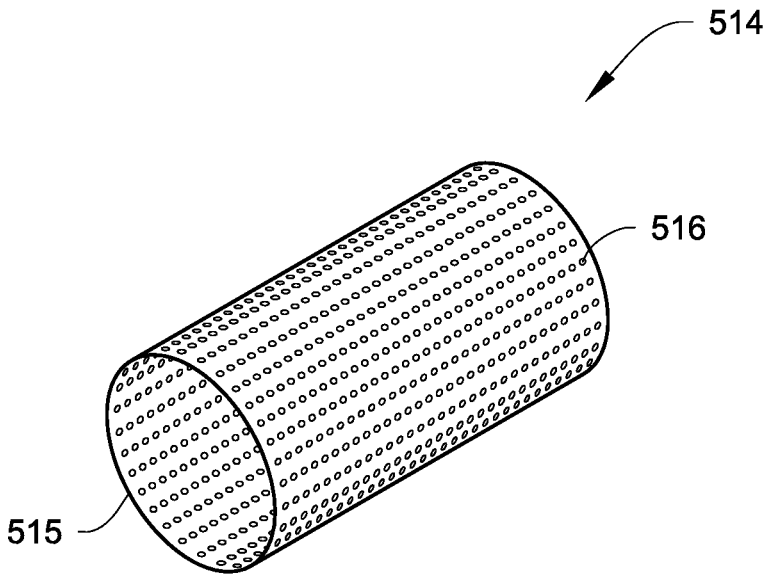

As illustrated in FIG. 5C, the airflow passage 514 may be made of a perforated sheet metal 515 with a plurality of openings 516.

As shown in FIG. 5A, the discharge 552 of the fan 550 has a circular shape in this embodiment. The airflow passage 514 may be shaped to match the circular shape of the discharge 552 of the fan 550. Generally, the airflow passage 514 has a cylindrical shape to match the circular shape of the discharge 552 of the fan 550, as illustrated in FIGS. 5A to 5D.

Figure 5D:
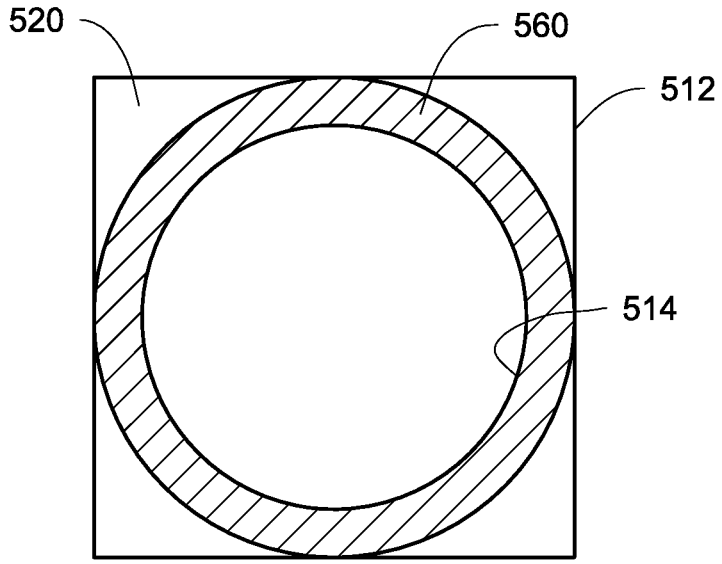

As illustrated in FIG. 5D, the airflow passage 514 and plenum 512 define the enclosed space 520 therebetween. Acoustic energy of a discharge airflow of the fan 550 may be dispersed into the space 520 through the openings 516. An acoustic energy dispersing material 560 may also be disposed in the space 520 to disperse acoustic energy by, for example, absorbing the acoustic energy. The acoustic energy dispersing material 560 may be disposed next to the airflow passage 514.

It is to be appreciated that other embodiment of the plenum, such as disclosed in FIGS. 2A to 2D, 3A to 3C, can also be adapted to use with a discharge fan of an outdoor unit of a HVAC system.

Generally, the airflow passage can be shaped to match the shape of a discharge of a fan. This may help minimize a pressure drop in the discharge airflow when the discharge airflow flowing through the airflow passage.

It is to be appreciated that the embodiments as disclosed herein may be generally used in any suitable ductwork. The embodiments of the plenum as disclosed herein may have the benefit of acoustic energy dispersing effect of a plenum and the benefit of a relative low pressure drop of a duct made of a solid sheet material. The embodiments of the plenum behaves differently from a duct with a relatively thick (e.g. 4-8 inches) liner or outboard insulation (e.g. a low pressure drop silencer), or an acoustical plenum acting as an expansion chamber where a cross sectional area is substantially different than the inlet/discharge dimensions.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. An acoustic dispersing airflow passage, comprising:

a plenum housing having a first end and a second end;

a perforated wall disposed within the plenum housing, the perforated wall having an inner side and an outer side, the outer side being disposed relatively closer to the plenum housing than the inner side, the inner side being opposite the outer side, the perforated wall surrounding an airflow passage, the perforated wall extending between the first end and the second end of the plenum housing, the perforated wall being enclosed by the plenum housing;

a centrifugal fan disposed outside of the plenum housing, the centrifugal fan being fluidly connected to the airflow passage, the centrifugal fan being configured to deliver a stream of air through the airflow passage;

an acoustic dispersing space between the plenum housing and the outer side of the perforated wall, the acoustic dispersing space being free of acoustic dispersing material, the acoustic dispersing space having a first volume, the acoustic dispersing space surrounding the airflow passage;

the airflow passage having a second volume; and the first volume being at least two times larger than the second volume.

2. The acoustic dispersing airflow passage of claim 1, wherein the airflow passage has a uniform cross section along a longitudinal direction between the first end and the second end, and the cross section of the airflow passage matches a profile of the centrifugal fan.

3. The acoustic dispersing airflow passage of claim 1, further comprising an acoustic dispersing material disposed on the perforated wall.

4. The acoustic dispersing airflow passage of claim 1, wherein a thickness of an acoustic dispersing material is about 1 to about 4 inches.

5. The acoustic dispersing airflow passage of claim 1, further comprising an acoustic dispersing material disposed on the perforated wall inside the airflow passage.

6. The acoustic dispersing airflow passage of claim 1, wherein the plenum housing has four sides, and relative positions of the airflow passage with respect to the four sides of the plenum housing are different.

7. The acoustic dispersing airflow passage of claim 1, wherein the plenum housing has an upper side and a lower side and a distance between the airflow passage and the upper side of the plenum housing is different from a distance between the airflow passage and the lower side of the plenum housing.

8. The acoustic dispersing airflow passage of claim 1, wherein the perforated wall has a plurality of openings, wherein the openings have a combined surface area about 15% to 58% of a total surface area of the perforated wall.

9. The acoustic dispersing airflow passage of claim 1, wherein the plenum housing is configured to be attached to an inlet of the centrifugal fan.

10. The acoustic dispersing airflow passage of claim 1, wherein the plenum housing has a length from about 1 to 6 feet from the first end to the second end.

* * * * *